US011181109B2

(12) United States Patent
Jeon et al.

(10) Patent No.: US 11,181,109 B2
(45) Date of Patent: Nov. 23, 2021

(54) SCROLL COMPRESSOR

(71) Applicant: LG Electronics Inc., Seoul (KR)

(72) Inventors: Nayoung Jeon, Seoul (KR); Taekyoung Kim, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 159 days.

(21) Appl. No.: 16/414,110

(22) Filed: May 16, 2019

(65) Prior Publication Data

US 2019/0353163 A1 Nov. 21, 2019

(30) Foreign Application Priority Data

May 17, 2018 (KR) ..... 10-2018-0056617

(51) Int. Cl.
*F04C 27/00* (2006.01)
*F04C 18/02* (2006.01)
*F04C 29/02* (2006.01)

(52) U.S. Cl.
CPC ..... *F04C 29/026* (2013.01); *F04C 18/0215* (2013.01); *F04C 27/001* (2013.01); *F04C 27/008* (2013.01); *F04C 2210/22* (2013.01); *F04C 2240/102* (2013.01)

(58) Field of Classification Search
CPC .... F04C 27/001; F04C 29/026; F04C 27/008; F04C 18/0215; F04C 27/003; F04C 2240/102; F04C 29/02; F04C 27/00; F04C 18/0207; F04C 18/0223; F04C 18/023–0238; F04C 29/021; F04C 29/028
See application file for complete search history.

(56) References Cited

U.S. PATENT DOCUMENTS

2016/0040672 A1* 2/2016 Lee ..... F04C 29/026 417/410.5
2018/0073505 A1 3/2018 Choi et al.

FOREIGN PATENT DOCUMENTS

| | | | |
|---|---|---|---|
| CN | 105370576 | 3/2016 | |
| EP | 2063122 | 5/2009 | |
| EP | 2063122 A1 * | 5/2009 | ..... F04C 29/045 |
| JP | 2008064076 | 3/2008 | |
| JP | 2008095520 | 4/2008 | |
| JP | 2013137004 | 7/2013 | |
| WO | WO2015085283 | 6/2015 | |

OTHER PUBLICATIONS

Chinese Office Action in Chinese Application No. 201910409258.X, dated Jul. 24, 2020, 12 pages (with English translation).
Extended European Search Report in European Application No. 19175017.3, dated Sep. 20, 2019, 7 pages.

* cited by examiner

*Primary Examiner* — Alexander B Comley
*Assistant Examiner* — David N Brandt
(74) *Attorney, Agent, or Firm* — Fish & Richardson P.C.

(57) ABSTRACT

A scroll compressor includes a refrigerant discharge flow passage and an oil recovery flow passage that are separated from each other. The scroll compressor further includes a flow passage separation unit configured to separate an intermediate space between a drive portion and a compression portion into an inner space communicating with the refrigerant flow passage and an outer space communicating with the oil flow passage to separate the refrigerant discharge path from the oil recovery path.

20 Claims, 10 Drawing Sheets

SCROLL COMPRESSOR

CROSS-REFERENCE TO RELATED APPLICATIONS

This application claims the benefit of Korean Patent Application No. 10-2018-0056617, filed on May 17, 2018, which is hereby incorporated by reference as if fully set forth herein.

BACKGROUND OF THE INVENTION

Field of the Invention

The present invention relates to a scroll compressor with a refrigerant discharge flow passage and an oil recovery flow passage separated from each other to improve efficiency and reliability of the compressor.

Discussion of the Related Art

Generally, a compressor is applied to a vapor compression type refrigeration cycle (hereinafter referred to simply as a refrigeration cycle) such as a refrigerator or an air conditioner.

Compressors can be divided into reciprocating compressors, rotary compressors, and scroll compressor according to how the refrigerant is compressed.

The scroll compressor is a compressor in which a rotating scroll pivotably engaged with a fixed scroll fixed to the inner space of a hermetically sealed container to form a compression chamber between a fixed lap of the fixed scroll and a rotating lap of the rotating scroll.

The scroll compressor is widely employed in an air conditioner or the like to compress a refrigerant because it can obtain a relatively high compression ratio as compared with other types of compressors and can obtain a stable torque as the intake, compression and discharge operations of the refrigerant are smoothly connected to each other.

Scroll compressors may be divided into an upper compression compressor or a lower compression compressor depending on the positions of the compression portion and the drive portion. In the upper compression compressor, the compression portion is positioned over the drive portion. In the lower compression compressor, the compression portion is positioned under the drive portion.

Typically, in the case of a high-pressure scroll compressor, a discharge pipe is positioned far from the compression portion such that oil can be separated from the refrigerant in the inner space of the casing. Therefore, in the high-pressure scroll compressor of the upper compression type, the discharge pipe is positioned between the drive portion and the compression unit. On the other hand, in a high-pressure scroll compressor of the lower compression type, the discharge pipe is positioned over the drive portion.

Accordingly, in the case of the upper compression compressor, the refrigerant discharged from the compression portion moves toward the discharge pipe in the intermediate space between the drive portion and the compression portion rather than moving to the drive portion. On the other hand, in the lower compression compressor, the refrigerant discharged from the compression portion moves toward the discharge pipe in an oil separation space formed on the upper side of the drive portion after passing through the drive portion.

At this time, the oil separated from the refrigerant in a first space, which is the oil separation space, passes through the drive portion and moves to an oil reservoir space formed on the lower side of the compression unit, and the refrigerant discharged from the compression portion also moves to the oil separation space through the drive portion.

However, in the conventional lower compression scroll compressor, interference occurs between the discharge path and the oil recovery path of the refrigerant as the paths are directed in the opposite directions as described above. Thereby, the refrigerant and the oil cause flow resistance to each other.

In particular, the oil is pressed by the high-pressure refrigerant and obstructed from returning to the oil reservoir space. As a result, oil shortage occurs inside the casing, resulting in friction loss or abrasion in the compression unit.

Hereinafter, a conventional scroll compressor having a flow passage separation unit for preventing the refrigerant discharge path and the oil recovery path from interfering with each other will be described.

FIGS. 1 and 2 are cross-sectional views illustrating a conventional scroll compressor. Here, for reference, FIGS. 1 and 2 are disclosed in Korean Patent Application Publication No. 10-2017-0047554.

Referring to FIGS. 1 and 2, the conventional scroll compressor includes a cylindrical shell 11 having an inner space, a drive portion 20, a compression portion 30 disposed on the lower side of the drive portion 20, and a rotary shaft 50 configured to transmit the rotational power of the drive portion 20 to the compression portion 30. The drive portion 20 includes a stator 21 coupled to the cylindrical shell 11 and a rotator 22 rotatably arranged inside the stator 21.

The conventional scroll compressor further includes a flow passage separation unit 40 arranged between the drive portion 20 and the compression portion 30 to separate the refrigerant flow passages 311*a*, 413*a* and G2 from the oil flow passages 21*a* and 311*c*.

The flow passage separation unit 40 includes a first flow passage guide 410 axially protruding from an upper surface of the compression portion 30, a second flow passage guide 420 axially protruding from a lower surface of the drive portion 20, and a sealing member 430 disposed between the first and second flow passage guides 410 and 420.

The sealing member 430 is formed in a ring shape and inserted into sealing grooves 411*c* and 421*b* provided in at least one of the first and second flow passage guides 410 and 420. Here, the sealing member 430 functions to separate the refrigerant flow passages 311*a*, 413*a*, and G2 from the oil flow passages 21*a* and 311*c*.

However, since the conventional sealing member 430 is formed in a ring shape, the sealing member 430 fails to be fixed in the sealing grooves 411*c* and 421*b*. Thereby, refrigerant leakage may occur.

Therefore, when a refrigerant leakage path is created, the refrigerant discharge path and the oil recovery path interfere with each other as in the conventional lower compression scroll compressor, and the refrigerant and oil cause flow resistance to each other.

At this time, the oil separated in the inner space of the casing may be mixed with the discharged refrigerant again and discharged from the compressor due to interference between the discharge path of the refrigerant and the recovery path of the oil. Thereby, the amount of oil leakage from the scroll compressor is increased, and the oil shortage in the compressor may be worsened.

As the oil recovery flow passage for moving the oil accumulated between the drive portion 20 and the compression portion 30 to the second space of the cylindrical shell 11 is not sufficiently secured, there may be oil remaining on the upper side of the compression portion 30. Then, the remaining oil is mixed with the refrigerant and moved to the first space of the cylindrical shell 11. Since the oil that is moved is more likely to be discharged from the compressor, and the oil shortage in the compressor is worsened.

As a result, the efficiency of the compressor is lowered according to increase in the amount of oil leakage from the compressor, the amount of oil in the compressor is reduced, and the temperature inside the compressor is increased.

SUMMARY OF THE INVENTION

Accordingly, the present invention is directed to a scroll compressor that substantially obviates one or more problems due to limitations and disadvantages of the related art.

An object of the present invention is to provide a scroll compressor capable of reducing an oil discharge amount by separating a refrigerant discharge path from an oil recovery path in a casing.

Another object of the present invention is to provide a scroll compressor capable of smoothly moving the oil separated from the refrigerant in a first space inside the casing to a second space inside the casing without causing interference.

Another object of the present invention is to provide a scroll compressor capable of preventing the oil separated from the refrigerant in the first space inside the casing from being mixed with the refrigerant moving from the second space to the first space in the casing.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a scroll compressor includes a refrigerant discharge flow passage and an oil recovery flow passage separated from each other to improve efficiency and reliability of the compressor. Accordingly, the present invention may prevent the oil from being mixed with the discharged refrigerant, thereby reducing an oil discharge amount.

In another aspect of the present invention, a scroll compressor includes a first flow passage guide provided on one surface of a compression unit, a second flow passage guide provided on one surface of a drive portion, and a sealing member having one surface contacting one surface of the first flow passage guide and an opposite surface contacting one surface of the second flow passage guide. Thereby, the oil separated from the refrigerant in the first space may smoothly move to the second space of the casing without undergoing interference.

In another aspect of the present invention, a scroll compressor includes a first flow passage guide provided on one surface of a compression unit, a second flow passage guide provided on one surface of a drive portion, and a sealing member fixed between the first flow passage guide and the second flow passage guide by surface contact. Accordingly, the present invention may prevent the oil separated from the refrigerant from being mixed with the refrigerant moving from the second space of the casing to the first space.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a scroll compressor according to some embodiments of the present invention will be described with reference to the drawings.

Figure 3:
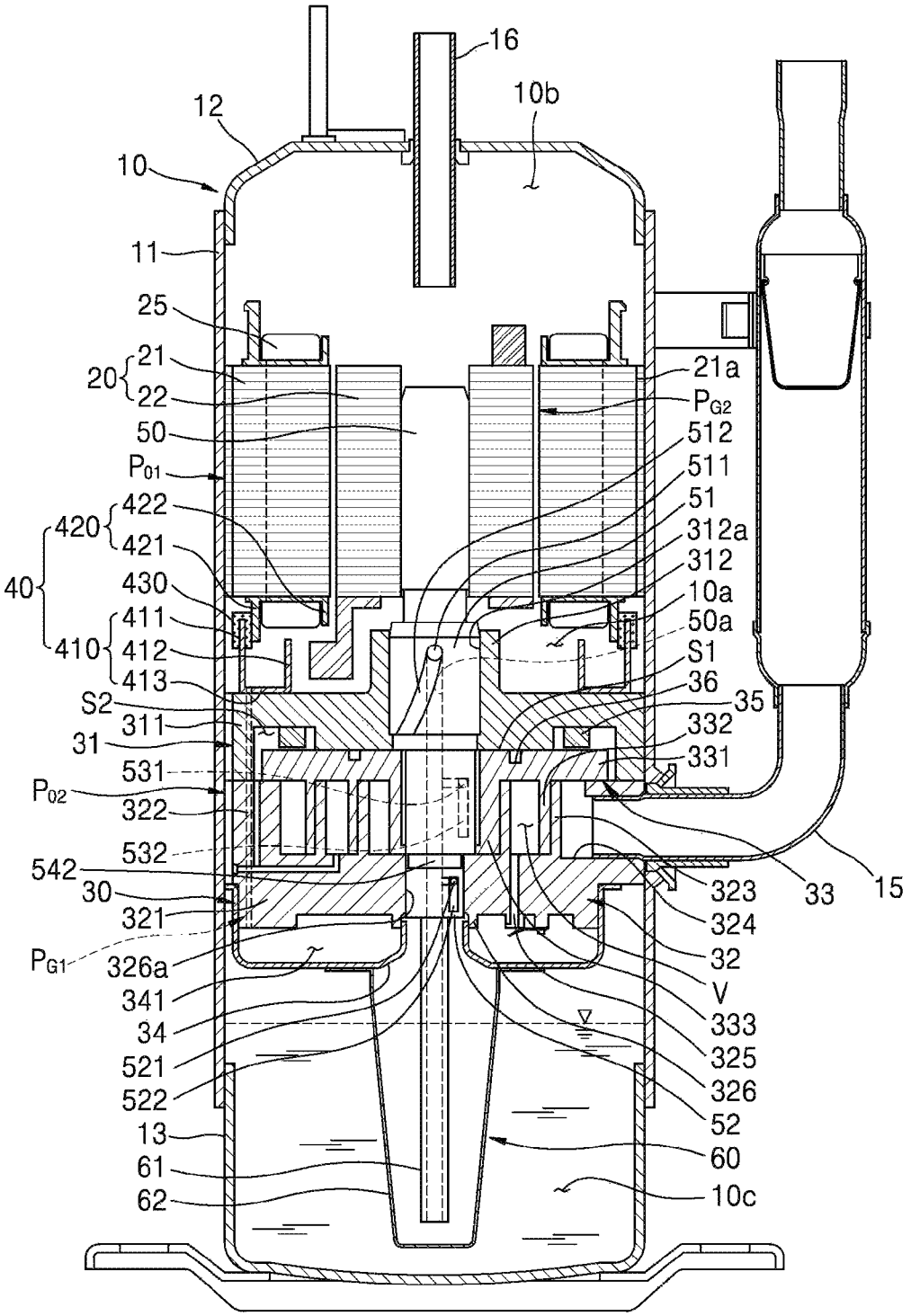
FIG. 3 is a longitudinal sectional view illustrating a scroll compressor according to an embodiment of the present invention.

FIG. 3 is a longitudinal sectional view illustrating a scroll compressor according to an embodiment of the present invention.

Referring to FIG. 3, the scroll compressor according to the present embodiment includes a drive portion 20 arranged inside a casing 10 to generate rotational power, and a compression portion 30 arranged spaced apart from the drive portion 20 to define a predetermined space 10*a* (hereinafter referred to as an intermediate space) and to receive the rotational power of the drive portion 20 to compress a refrigerant.

The casing 10 includes a main shell 11 forming a hermetically sealed container, a first shell 12 arranged to cover one surface of the main shell 11 to form the hermetically sealed container in cooperation with the main shell 11, and a second shell 13 arranged to cover an opposite surface of the main shell 11 to form the hermetically sealed container in cooperation with the main shell 11 and define a second space 10*c*.

A refrigerant intake pipe 15 passes through a side surface of the main shell 11 and directly communicates with an intake chamber of the compression portion 30. A refrigerant discharge pipe 16 communicating with a first space 10*b* of the casing 10 may be installed in the first shell 12. The refrigerant discharge pipe 16 is a passage through which the compressed refrigerant discharged from the compression portion 30 to the first space 10*b* of the casing 10 is discharged to the outside. The refrigerant discharge pipe 16 may be inserted all the way to the middle of the first space 10*b* of the casing 10 such that the first space 10*b* can be used as an oil separation space.

That is, in the compressor of the present invention, the compression portion 30 may be arranged spaced apart from the drive portion 20 to face away from the refrigerant discharge pipe 16, and the first space 10*b* may be formed between the drive portion 20 and the refrigerant discharge pipe 16.

For reference, an oil separator (not shown) for separating the oil mixed with the refrigerant may be arranged in the casing 10 including the first space 10*b* or connected to the refrigerant discharge pipe 16 in the first space 10*b*.

The stator 21 has teeth and slots arranged on the inner circumferential surface thereof in a circumferential direction to form multiple coil winding portions (not assigned a reference numeral), around which a coil 25 is wound.

Here, a second refrigerant flow passage PG2 is formed between the inner circumferential surface of the stator 21 and the outer circumferential surface of the rotator 22.

Accordingly, the refrigerant discharged to an intermediate space 10*a* between the drive portion 20 and the compression portion 30 through a first refrigerant flow passage PG1, which will be described later, moves into the first space 10*b*, which is formed on one side of the drive portion 20, through the second refrigerant flow passage PG2.

A plurality of D-cut surfaces 21*a* is formed on the outer circumferential surface of the stator 21 in the circumferential direction.

Here, a first oil flow passage PO1 may be formed between the D-cut surfaces 21*a* and the inner circumferential surface of the main shell 11 such that the oil passes through the first oil flow passage PO1.

Accordingly, the oil separated from the refrigerant in the first space 10*b* moves into the second space 10*c* through the first oil flow passage PO1 and a second oil flow passage PO2, which will be described later.

The compression portion 30 is disposed under the stator 21 at a predetermined distance from the stator 21.

The compression portion 30 may include a main frame 31, a fixed scroll 32, a rotating scroll 33, a discharge cover 34, and an Oldham ring 35.

The main frame 31 may be fixedly coupled to the inner circumferential surface of the casing 10. The outer circumferential surface of the main frame 31 may be heat-shrunk or welded and fixedly coupled to the inner circumferential surface of the main shell 11.

The main frame 31 may be formed to have a shape corresponding to the inner circumferential surface of the main shell 11 and be formed in a plate shape having a predetermined thickness. A frame sidewall portion (hereinafter referred to as a first sidewall portion) 311 may be formed at an edge of the main frame 31. The outer circumferential surface of the frame sidewall portion 311 may have a circular shape. A plurality of communication grooves 311*b* (see FIG. 4) may be formed in the outer circumferential surface of the first sidewall portion 311 in a circumferential direction. The first communication groove 311*b* defines the second oil flow passage PO2 in cooperation with a second communication groove 322*b* of the fixed scroll 32, which will be described later.

A first bearing accommodation portion 312 for supporting a main bearing portion 51 of the rotary shaft 50, which will be described later, is formed at the center of the main frame 31. The first bearing accommodation portion 312 may be provided with a first bearing accommodation hole 312*a* into which the main bearing portion 51 of the rotary shaft 50 is rotatably inserted so as to be radially supported.

The fixed scroll 32 may be arranged on one surface of the main frame 31 while the rotating scroll 33 eccentrically coupled to the rotary shaft 50 is interposed therebetween. The fixed scroll 32 may be fixedly coupled to the main frame 31 or to the inner circumferential surface of the main shell 11.

The fixed scroll 32 has a fixed head plate portion 321 (hereinafter referred to as a first head plate portion) that forms a main body of the fixed scroll and has an approximately circular disc shape. A scroll sidewall portion 322 (hereinafter referred to as a second sidewall portion) coupled to the lower surface of the main frame 311 may be formed at an edge of the first head plate portion 321.

An intake port 324 through which the refrigerant intake pipe 15 communicates with the intake chamber may be formed on one side of the second sidewall portion 322 in a penetrating manner. A discharge port 325 through which the compressed refrigerant is discharged may be formed at the center of the first hard plate portion 321 so as to communicate with the discharge chamber 341.

The second communication groove 322*b* described above is formed in the outer circumferential surface of the second sidewall portion 322. The second communication groove 322*b* forms, in cooperation with the first communication groove 311*b* of the first sidewall portion 311, the second oil flow passage PO2 for guiding the oil to the second space 10*c*.

The discharge cover 34 for guiding the refrigerant discharged from a compression chamber V to a refrigerant flow passage, which will be described later, may be coupled to one side of the fixed scroll 32.

The discharge cover 34 is configured to accommodate, in the inner space thereof, the discharge port 325 and the inlet of the first refrigerant flow passage PG1 for guiding the refrigerant discharged from the compression chamber V through the discharge port 325 to a space between the drive portion 20 and the compression portion 30.

Here, the first refrigerant flow passage PG1 is arranged to pass through the second sidewall portion 322 of the fixed scroll 32 and the first sidewall portion 311 of the main frame 31 one by one and then pass through the inside of the flow passage separation unit 40.

Thus, the second oil flow passage PO2 described above is formed on the outside of the oil flow passage separation unit 40 to communicate with the first oil flow passage PO1, and the first refrigerant flow passage PG1 is formed inside the oil flow passage separation unit 40 to communicate with the second refrigerant flow passage PG2. That is, the flow passage separation unit 40 functions to separate the first and second oil flow passages PO1 and PO2 from the first and second refrigerant flow passages PG1 and PG2.

Details of the flow passage separation unit 40 will be described later.

A fixed lap 323 (hereinafter referred to as a first lap) capable of forming the compression chamber V by engaging with a rotating lap 33 (hereinafter referred to as a second lap), which will be described later, may be formed on one surface of the first head plate portion 321. The first lap 323 will be described below along with the second lap 332.

A second bearing accommodation portion 326 is formed at the center of the first head plate portion 321 to support a second bearing portion 52 of the rotary shaft 50, which will be described later. The second bearing accommodation portion 326 may be provided with a second bearing accommodation hole 326*a* penetrated in an axial direction to radially support the second bearing portion 52.

The rotating scroll 33 may be provided with a rotating head plate portion 311 (hereinafter referred to as a second plate portion) formed in an approximately circular disc shape. The second lap 332 to engage with the first lap 322 to form the compression chamber may be formed on the lower surface of the second head plate portion 331.

The second lap 332 and the first lap 32 may be formed in an involute shape, but embodiments are not limited thereto. The first lap 323 and the second lap 332 can have any shape as long as they can form the compression chamber.

Here, the involute shape refers to a curve corresponding to a locus drawn by an end of a thread when the thread wound around a base circle having an arbitrary radius is released.

A rotary shaft coupling portion 333 may be axially formed at the center of the second head plate portion 331 in a penetrated manner. The rotary shaft coupling portion 333 may form the inner end of the second lap 332, and an eccentric portion 53 of the rotary shaft 50, which will be described later, may be rotatably inserted into and coupled to the rotary shaft coupling portion 333.

The outer circumferential surface of the rotary shaft coupling portion 333 may be connected to the second lap 332 to form the compression chamber V in cooperation with the first lap 322 during the compression process.

In addition, the rotary shaft coupling portion 333 may be formed to have a height so as to overlap the second lap 332 in the same plane, and the eccentric portion 53 of the rotary shaft 50 may be disposed at a height at which the eccentric portion 53 overlaps the second lap in the same plane. That is, in the scroll compressor of the present invention, the rotary shaft 50 may be arranged through at least a part of the rotating scroll 32 as well as the rotating scroll 33.

Accordingly, the repulsive force and the compressive force of the refrigerant are canceled by each other as they are applied to the same plane with respect to the second head plate portion 331. Thus, action of the compressive force and the repulsive force may be prevented from tilting the rotating scroll 33.

The compression chamber V may be formed between the first head plate portion 321 and the first lap 323, and between the second lap 332 and the second head plate portion 331. An intake chamber, an intermediate pressure chamber, and a discharge chamber may be serially formed in an extension direction of the laps.

The rotating scroll 33 may be pivotally installed between the main frame 31 and the fixed scroll 32.

The Oldham ring 35 is arranged between the upper surface of the rotating scroll 33 and the lower surface of the main frame 31 corresponding thereto to prevent the rotating scroll 33 from rotating. Further, a sealing member 36 for forming a back pressure chamber S1 may be arranged on the inner side of the Oldham ring 35.

The upper portion of the rotary shaft 50 may be press-fitted and coupled to the center of the rotator 22, while the lower portion thereof may be coupled to the compression portion 30 so as to be radially supported. Thus, the rotary shaft 50 transmits the rotational power of the drive portion 20 to the rotating scroll 33 of the compression portion 30. Then, the rotating scroll 33 eccentrically coupled to the rotary shaft 50 is caused to revolve or rotate with respect to the fixed scroll 32.

A main bearing portion 51 (hereinafter referred to as a first bearing portion) may be formed at the lower half portion of the rotary shaft 50 so as to be inserted into the first bearing accommodation hole 312*a* of the main frame 31 and radially supported. A sub-bearing portion 52 (hereinafter referred to as a second bearing portion) may be formed at one side of the first bearing portion 51 so as to be inserted into the second bearing accommodation hole 326*a* of the fixed scroll 32 and radially supported. In addition, the eccentric portion 53 may be formed between the first bearing portion 51 and the second bearing portion 52 so as to be inserted into the rotary shaft coupling portion 333 and coupled therewith.

The first bearing portion 51 and the second bearing portion 52 may be coaxially formed so as to have the same axial center, and the eccentric portion 53 may be formed to be radially eccentric with respect to the first bearing portion 51 or the second bearing portion 52. The second bearing portion 52 may be formed to be eccentric with respect to the first bearing portion 51.

An oil supply flow passage 50*a* for supplying oil to each bearing portion and the eccentric portion may be axially formed in the rotary shaft 50. As the compression portion 30 is arranged spaced apart from the drive portion 20, the oil supply flow passage 50*a* may be formed by grooving from one end of the rotary shaft 50 to approximately one surface of the stator 21 or the middle of the height of the stator 21 or to a position above or higher than an end of the bearing part 51. Of course, in some cases, the oil supply flow passage may be formed by penetrating the rotary shaft 50 in the axial direction.

An oil feeder 60 for pumping the oil filling the second space 10*c* may be coupled to the lower end of the rotary shaft 50, that is, one end of the second bearing portion 52.

The oil feeder 60 may include an oil supply pipe 61 inserted into the oil supply flow passage 50*a* of the rotary shaft 50 and coupled therewith, and a blocking member 62 configured to accommodate the oil supply pipe 61 to block infiltration of foreign substances.

Each of the bearing portions 51 and 52 and the eccentric portion 53 of the rotary shaft 50 is provided with a sliding portion oil supply passage connected to the oil supply flow passage 50*a* to supply oil to each sliding portion.

The sliding portion oil supply passage includes a plurality of oil supply holes 511, 521 and 531 extending from the oil supply flow passage 50*a* toward the outer circumferential surface of the rotary shaft 50 in a penetrating manner, and a plurality of oil supply grooves 512, 522, and 532 formed in the outer circumferential surfaces of the respective bearing portions 51 and 52 to communicate with the oil supply holes 511, 521, 531 to lubricate the respective bearing portions 51 and 52 and the eccentric portion 53.

For example, a first oil supply hole 511 and a first oil supply groove 512 are formed in the first bearing portion 51. A second oil supply hole 521 and a second oil supply groove 522 are formed in the second bearing portion 52. And a third oil supply hole 531 and a third oil supply groove 532 are formed in the eccentric portion 53. The first oil supply groove 512, the second oil supply groove 522, and the third oil supply groove 532 are each formed in the shape of an elongated recess in the axial or oblique direction.

A first connection groove 541 having an annular shape is formed between the first bearing portion 51 and the eccentric portion 53, and a second connection groove 541 having an annular shape is formed between the eccentric portion 53 and the second bearing portion 52.

The lower end of the first oil supply groove 512 communicates with the first connection groove 541 and the upper end of the second oil supply groove 522 is connected to the second connection groove 542.

Accordingly, a part of the oil that lubricates the first bearing portion 51 through the first oil supply groove 512 flows down and is collected in the first connection groove 541. The collected oil flows into a first back pressure chamber S1, thereby forming a back pressure of the discharge pressure.

The oil that lubricates the second bearing portion 52 through the second oil supply groove 522 and the oil that lubricates the eccentric portion 53 through the third oil supply groove 532 may be collected in the second connection groove 542 and introduced into the compression portion 30 via the space between the leading end surface of the rotary shaft coupling portion 333 and the first head plate portion 321.

A small amount of oil that is suctioned in the direction directed from the first bearing portion 51 toward the drive portion flows out of the bearing surface at the end of the first bearing accommodation portion 312 of the main frame 31. Then, the oil flows down to an exposed surface 31*a* of the main frame 31. Subsequently, the oil on the upper surface 31*a* is recovered into the second space 10*c* through the first and second oil flow passages PO1 and PO2.

The oil discharged along with the refrigerant from the compression chamber V into the first space 10*b* of the casing 10 is separated from the refrigerant in the first space 10*b* of the casing 10, and is collected into the second space 10*c* through the first oil flow passage PO1 formed on the outer circumferential surface and the second oil flow passage PO2 formed on the outer circumferential surface of the compression portion 30.

Here, a flow passage separation unit 40 is provided between the drive portion 20 and the compression portion 30.

The oil separation unit 40 prevents the oil separated from the refrigerant in the first space 10*b* and moved into the second space 10*c* from interacting and re-mixing with the refrigerant discharged from the compression portion 30 and moved into the first space 10*b*.

That is, the oil flow passage separation unit 40 serves to separate the oil moved into the second space 10*c* from the refrigerant moved into the first space 10*b* to guide the oil and the refrigerant so as to smoothly circulate.

In some implementations, when the scroll compressor of the present invention is configured such that the refrigerant discharge pipe 16 faces upward and the compression portion 30 faces downward. Thereby, the process described above may be carried out more smoothly.

Hereinafter, operation of the scroll compressor according to the embodiment of the present invention will be described.

When power is applied to the drive portion 20 to generate rotational power, the rotary shaft 50 coupled to the rotator 22 of the drive portion 20 is rotated. Then, the rotating scroll 33 eccentrically coupled to the rotary shaft 50 rotates with respect to the fixed scroll 32 to form the compression chamber V between the first lap 323 and the second lap 332. The compression chamber V may form several continuous steps as the volume thereof is gradually narrowed down into the center thereof.

Thus, the refrigerant supplied from the outside of the casing 10 through the refrigerant intake pipe 15 may be directly introduced into the compression chamber V. The refrigerant is compressed as it is moved toward the discharge chamber of the compression chamber V by rotation of the rotating scroll 33. Then, the refrigerant is discharged from the discharge chamber to the discharge chamber 341 through the discharge port 325 in the fixed scroll 32.

Thereafter, the compressed refrigerant discharged into the discharge chamber 341 is discharged into the inner space of the casing 10 through the first refrigerant flow passage PG1 15 and the second refrigerant flow passage PG2, and is then discharged from the casing 10 through the refrigerant discharge pipe 16. Such operation is repeated.

The oil repeats a series of operations of flowing through the flow passage between the inner circumferential surface of the casing 10 and the stator 21 and the flow passage between the inner circumferential surface of the casing 10 and the outer circumferential surface of the compression portion 30 and returning to the second space 10*c*, which is an oil reservoir space.

Here, the flow passage separation unit 40 is provided in an intermediate space 10*a* (hereinafter referred to as a first space), which is an oil waypoint space formed between the lower surface of the drive portion 20 and the upper surface of the compression portion 30. The flow passage separation unit 40 prevents the refrigerant discharged from the compressing unit 30 from interfering with the oil moving from the first space 10*b* (hereinafter referred to as a second space) of the drive portion 20, which is the oil separation space, to the second space 10*c* (hereinafter referred to as a third space) of the compressing unit 30, which is the oil reservoir space.

To this end, the flow passage separation unit 40 according to the present embodiment divides the first space 10*a* into a space (hereinafter referred to as a refrigerant flow space A1) through which the refrigerant flows and a space (hereinafter referred to as an oil flow space A2) through which the oil flows.

Hereinafter, the flow passage separation unit 40 for separating the refrigerant flow space A1 and the refrigerant flow space A1 from each other will be described in detail.

Figure 1:
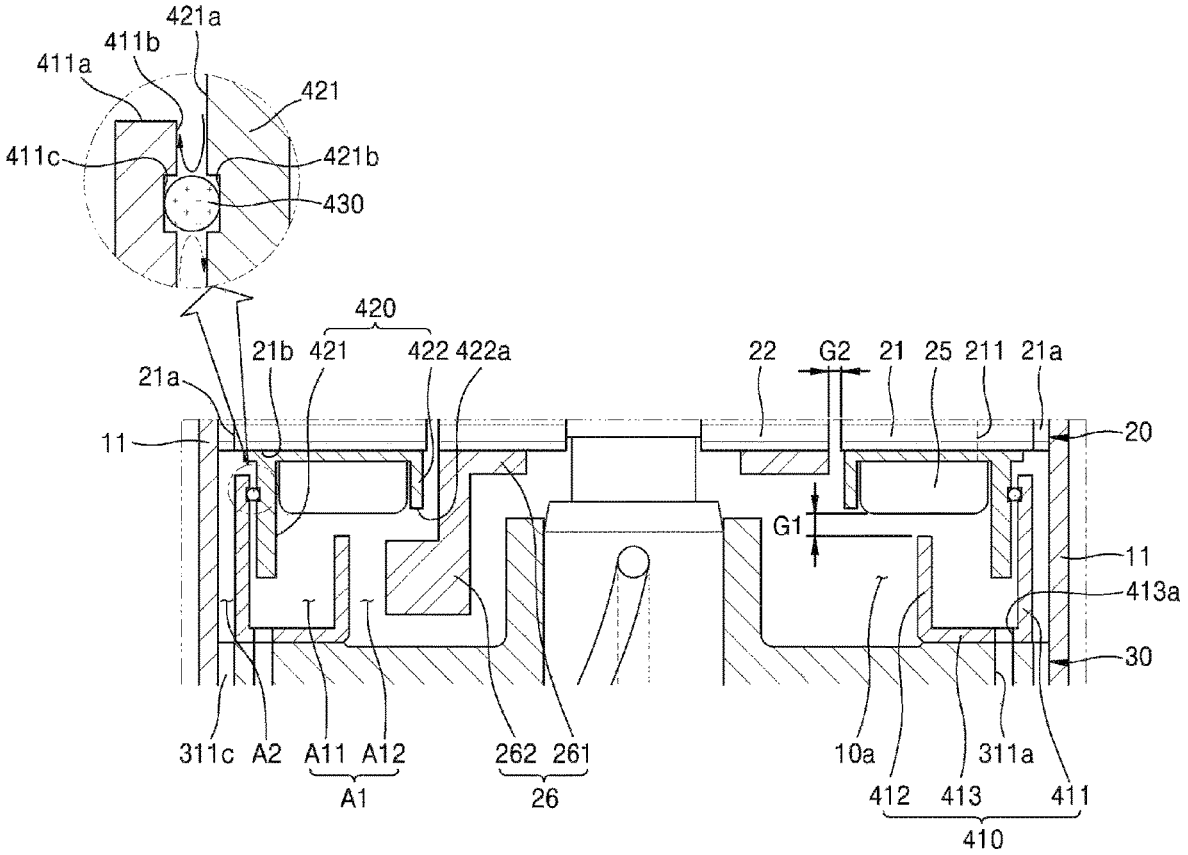
FIGS. 1 and 2 are cross-sectional views illustrating a conventional scroll compressor.
Figure 2:
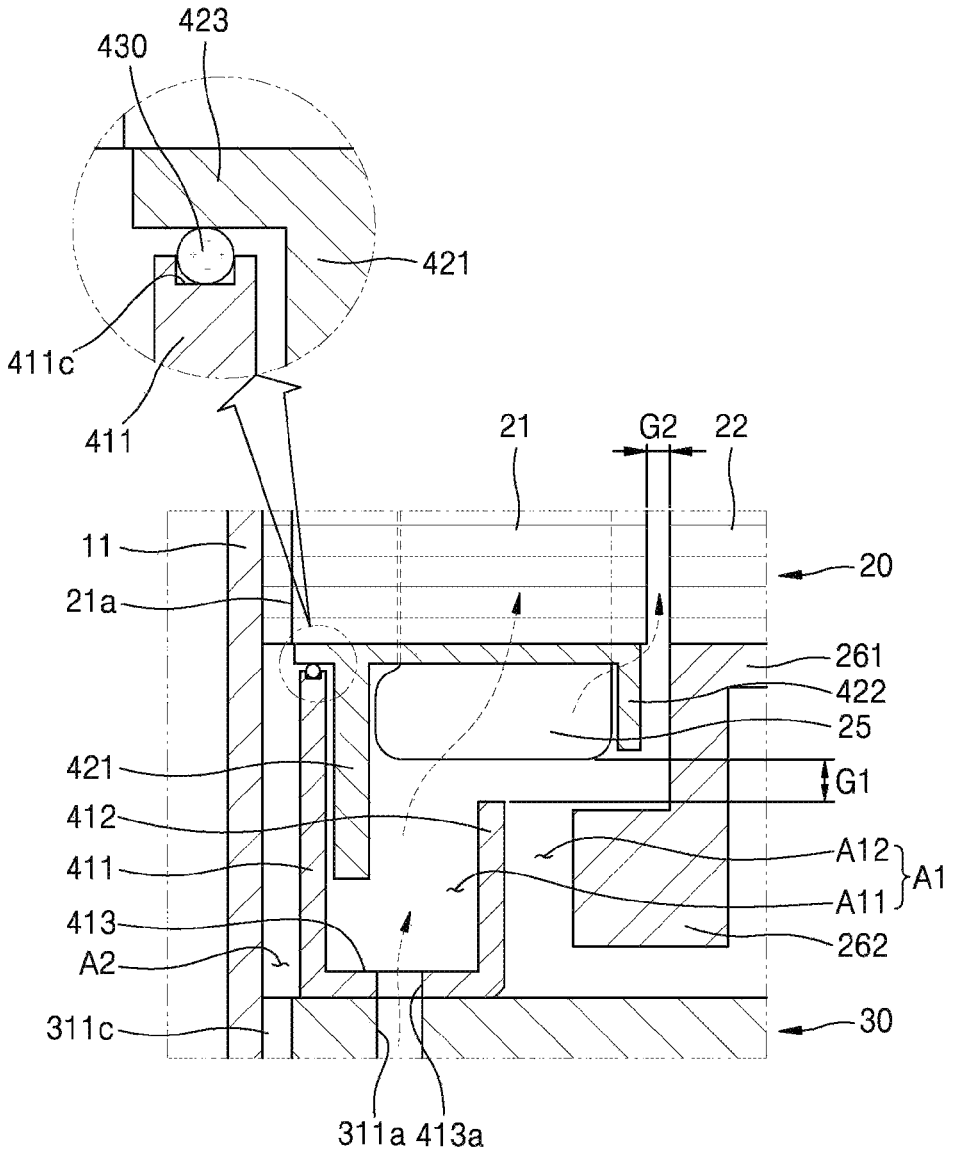
Figure 4:
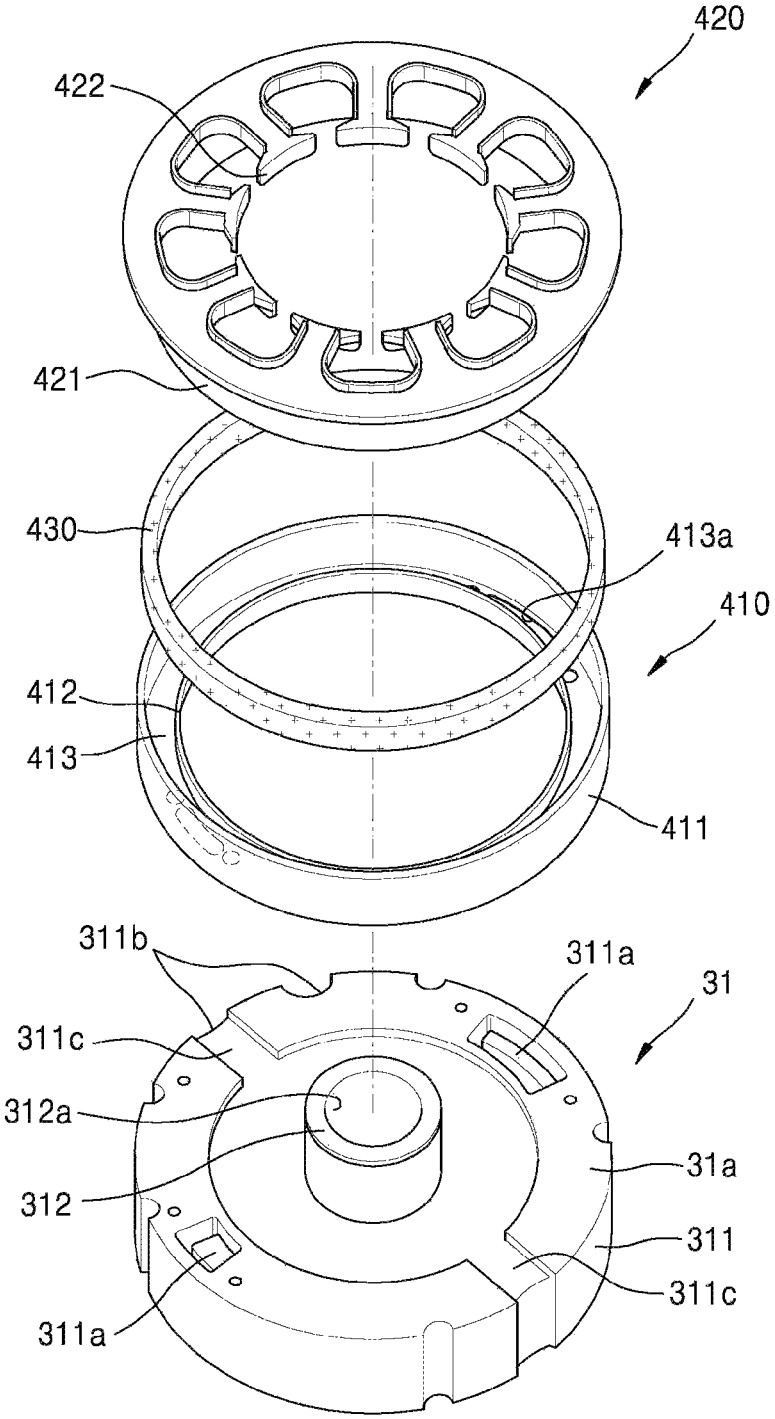
FIG. 4 is an exploded perspective view showing constituent elements of a flow passage separation unit of FIG. 3.
Figure 5:
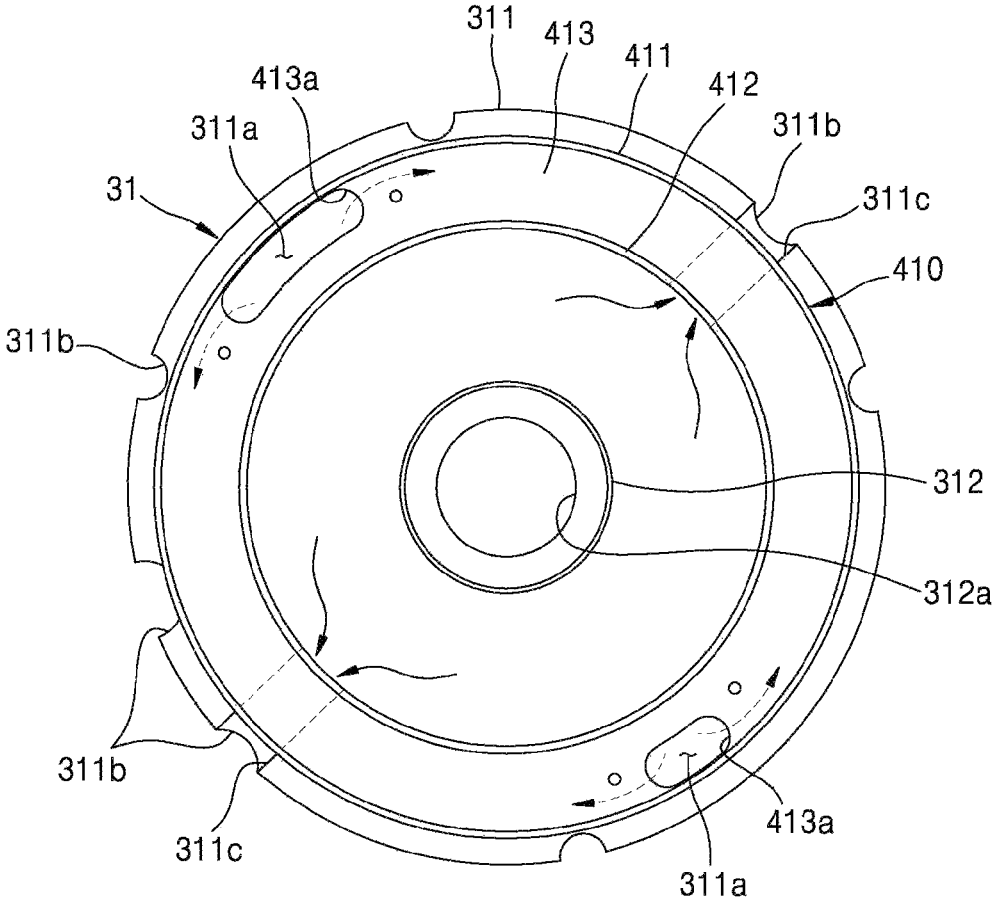
FIG. 5 is a top plan view of a first flow passage guide fixed to a main frame in the flow passage separation unit of FIG. 4.
Figure 6:
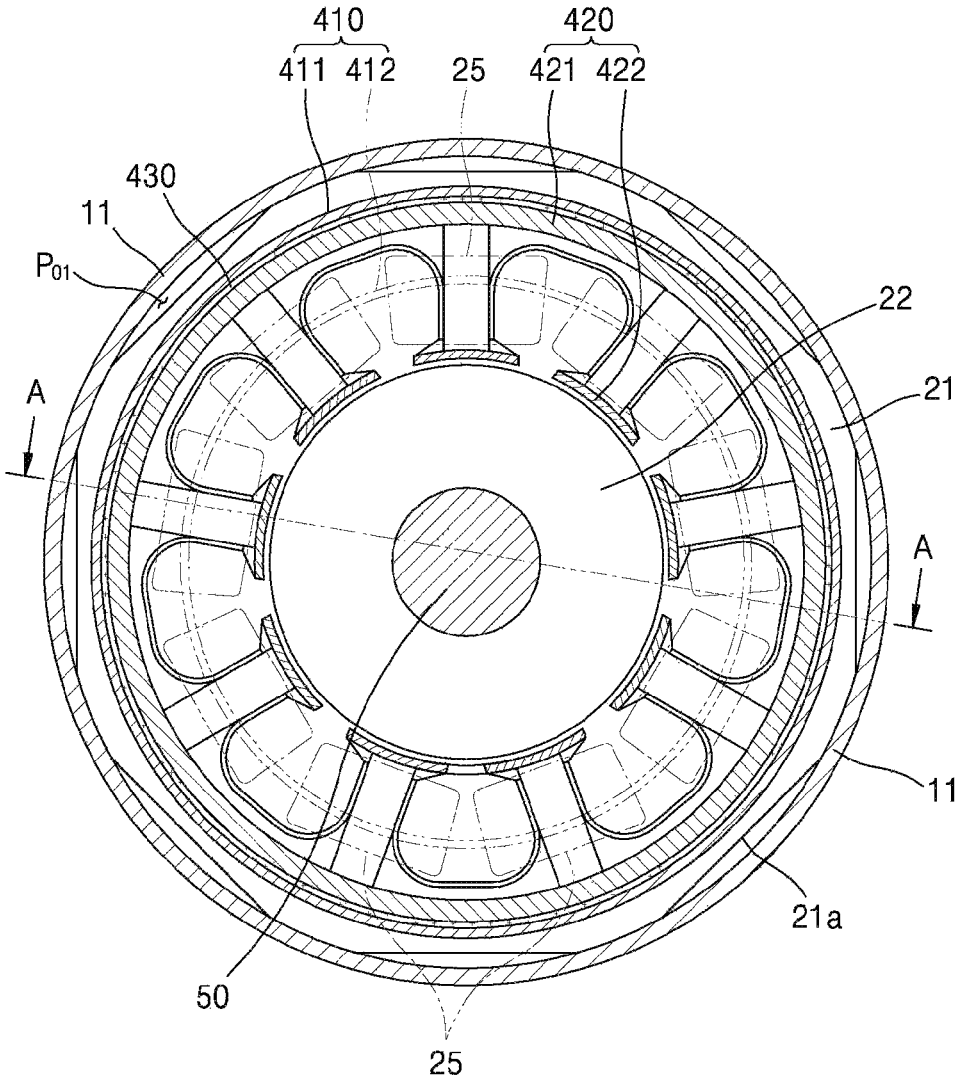
FIG. 6 is a bottom plan view of the first and second flow passage guides in the flow passage separation unit of FIG. 4.
Figure 7:
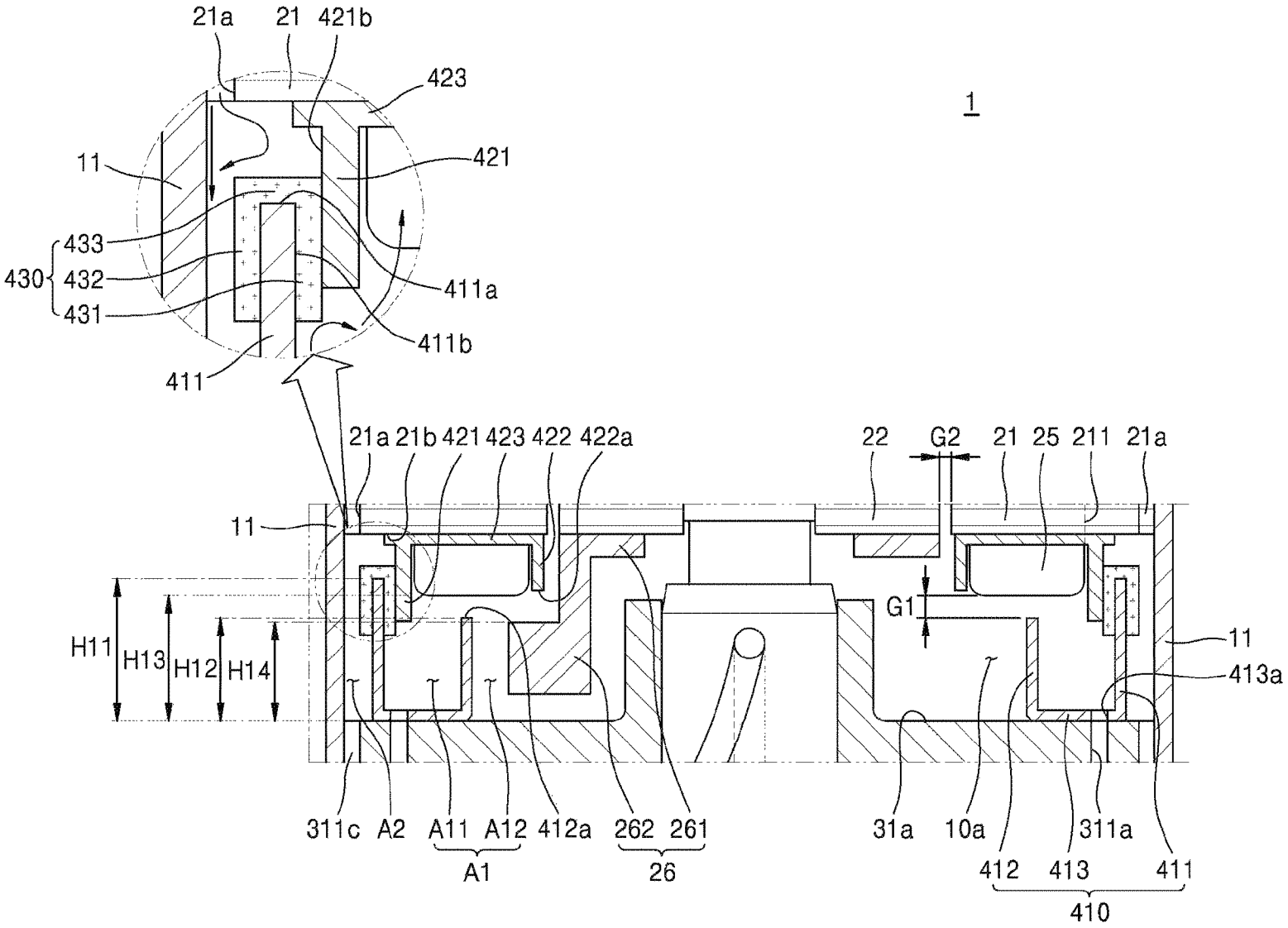
FIGS. 7 to 9 are sectional views of the flow passage separation unit according to some embodiments of the present invention, taken along line A-A of FIG. 6.
Figure 8:
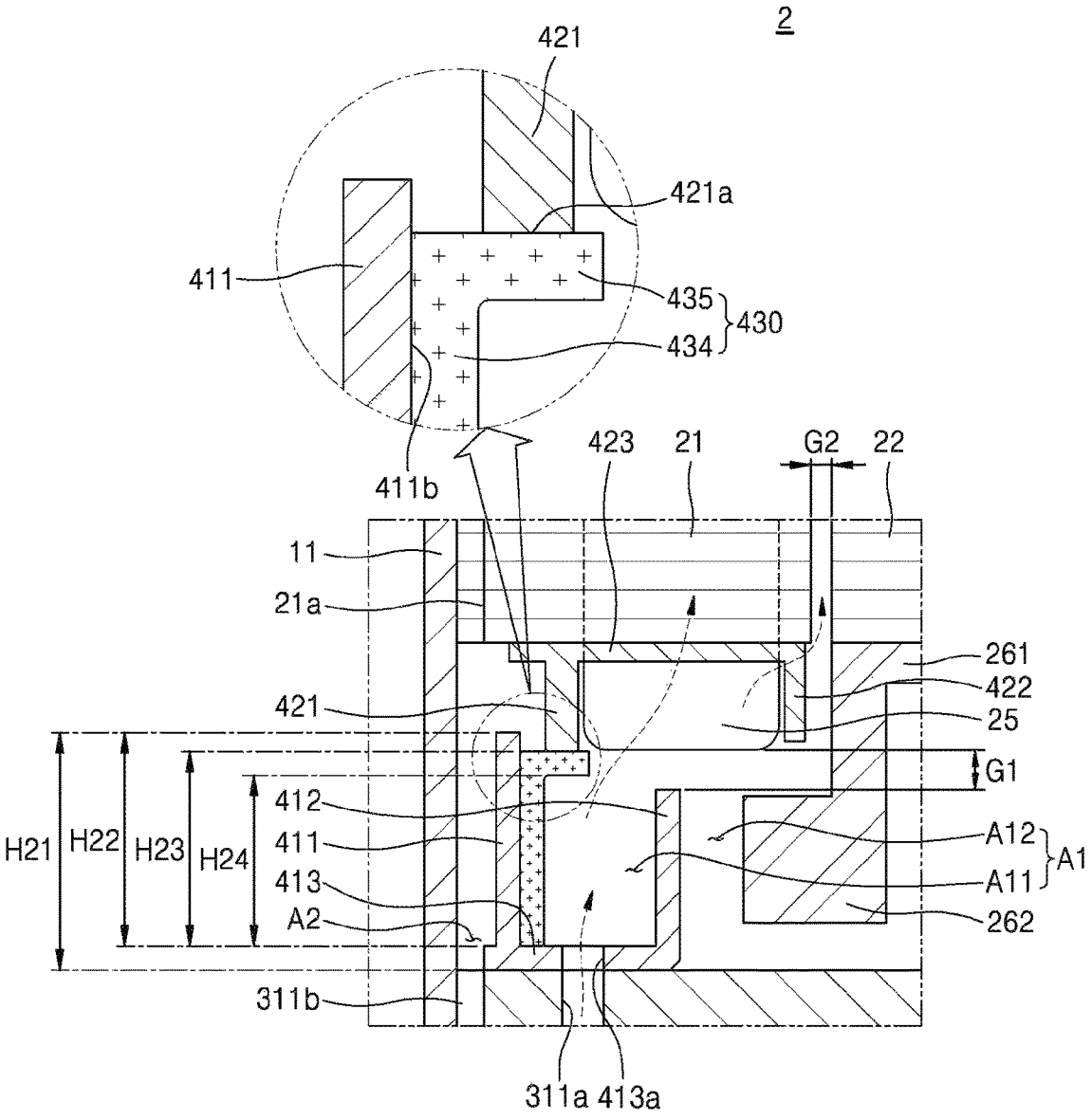
Figure 9:
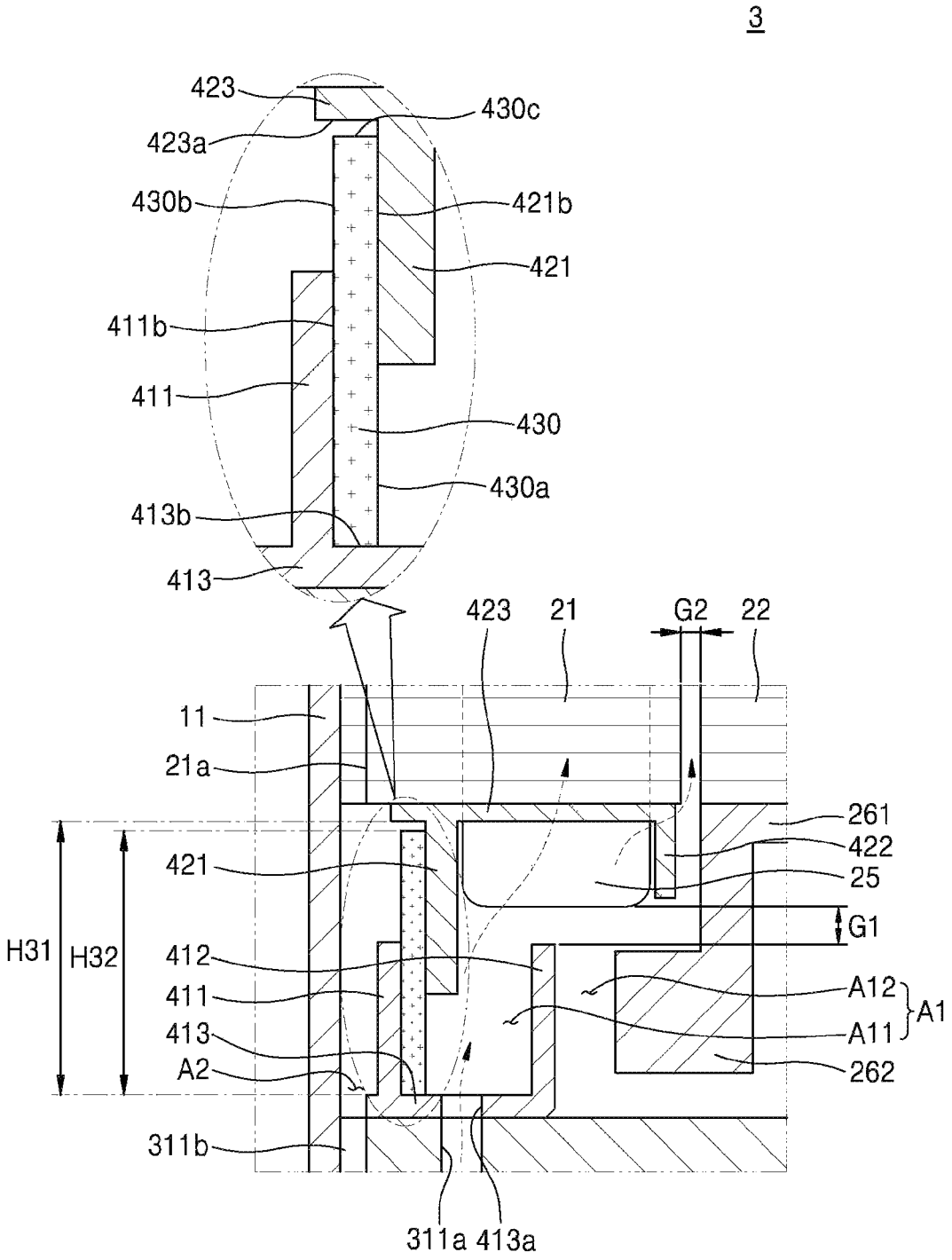

The scroll compressor of the present invention may have a structure similar to that of the conventional scroll compressor of FIGS. 1 and 2. Therefore, the following description will focus on differences from the conventional scroll compressor. FIG. 4 is an exploded perspective view showing constituent elements of the flow passage separation unit of FIG. 1. FIG. 5 is a top plan view of the first flow passage guide fixed to the main frame in the flow passage separation unit of FIG. 4. FIG. 6 is a bottom plan view of the first and second flow passage guides in the flow passage separation unit of FIG. 4. FIGS. 7 to 9 are sectional views of the flow passage separation unit according to some embodiments of the present invention, taken along line A-A of FIG. 6.

Referring to FIGS. 4 to 6, the flow passage separation unit 40 according to an embodiment of the present invention includes a first flow passage guide 410, a second flow passage guide 420, and a sealing member 430.

The first flow passage guide 410 is formed in an annular shape and fixedly coupled to the exposed surface 31*a* of the main frame 31. The first flow passage guide 410 includes a first annular wall portion 411 and a second annular wall portion 412, which are disposed to face each other, and an annular surface portion 413 connecting the first annular wall portion 411 to the second annular wall portion 412.

Specifically, the first annular wall portion 411 may be formed in an annular shape. One surface of the first annular wall portion 411 may be seated and supported on the exposed surface 31*a* of the main frame 31 and an opposite surface thereof may be disposed adjacent to the lower surface of the stator 21. Accordingly, the first annular wall portion 411 may be formed in a cylindrical shape having a predetermined height.

The first annular wall portion 411 may be positioned between the outer circumferential surface of the stator 21 and the side surface of the coil winding portion, or more specifically, between the D-cut surfaces 21*a* of the stator 21 and the slot 211 forming the coil winding portion.

Accordingly, the first annular wall portion 411 is positioned outside an outer extended portion 421 (hereinafter referred to as a first extended portion) of the second flow passage guide 420, which will be described later.

As shown in FIG. 7, the exposed surface 411*a* of the first annular wall portion 411 is spaced apart from the first surface 21*b* of the stator 21 by a predetermined distance. Here, the sealing member 430 is provided between the inner circumferential surface 411*b* of the first annular wall portion 411 and the outer circumferential surface 421*a* of the first extended portion 421 of the second flow passage guide 420, which is a member in contact with the inner circumferential surface 411*b*.

Thus, the refrigerant flow space A1, which is the inner space of the first annular wall portion 411, and the oil flow space A2, which is the outer space of the first annular wall portion 411, may be surely separated by the first annular wall portion 411, the first extended portion 421, and the sealing member 430.

That is, the first annular wall portion 411 separates the refrigerant flow passage from the oil flow passage. Thus, the intermediate space 10*a* is divided into the refrigerant flow space A1 and the oil flow space A2 by the first annular wall portion 411. Accordingly, the refrigerant discharged into the first space 10*b* moves along the refrigerant flow passages PG1 and PG2, and the oil recovered into the second space 10*c* moves along the oil flow passages PO1 and PO2.

The second annular wall portion 412 may be disposed on the inner side of the first annular wall portion 411 so as to be adjacent to the rotary shaft 50, and divide the refrigerant flow space A1 into a first refrigerant flow space A11 and a second refrigerant flow space A12.

Like the first annular wall portion 411, the second annular wall portion 412 may be formed in an annular shape having a predetermined height. One surface of the second annular wall portion 412 is seated and supported on the exposed surface 31*a* of the main frame 31 like the first annular wall portion 411 and an opposite surface 412*a* thereof protrudes toward the stator 21 so as to be spaced apart from one surface 21*b* of the stator 21 by a predetermined distance.

However, the height H12 of the second annular wall portion 412 may be less than the height H11 of the first annular wall portion 411. If the height H12 of the second annular wall portion 412 is excessively great as to make the second annular wall portion 412 contact the one surface 21*b* of the stator 21 or the gap G1 is excessively narrow, most of the refrigerant discharged to the inner side of the first annular wall portion 411 will move to the second space 10*b* only through the slot 211. This configuration may be a considerable obstacle to movement of the refrigerant to a gap G2 between the stator 21 and the rotator 22. Therefore, the height H12 of the second annular wall portion 412 is preferably less than the height H11 of the first annular wall portion 411.

Therefore, the second annular wall portion 412 of the first flow passage guide 410 may be positioned outside the second extended portion 422 of the second flow passage guide 420. In addition, the second annular wall portion 412 may be formed to have a height H12 less than the height H11 of the first annular wall portion 411 and also less than the height H13 of one end of the second extended portion 422 of the second flow passage guide 420 with respect to the exposed surface 31*a* of the main frame 31.

In addition, since the second annular wall portion 412 is provided with a balance weight 26 on the inner side thereof, the position and the height thereof may be set in consideration of the locus of the balance weight 26.

That is, the second annular wall portion 412 is provided to prevent the refrigerant discharged into the first space 10*a* through the first refrigerant flow passage PG1 from being stirred by orbiting of the balance weight 26.

Therefore, the second annular wall portion 412 may be formed to have a height greater than or equal to the height H14 of an eccentric weight portion 262 of the balance weight 26, while being positioned outside the locus of the balance weight 26. Here, the height H14 of the eccentric weight portion 262 is set to be lower than that of one end of the winding coil 25 in order to prevent the balance weight 26 from colliding with the winding coil 25.

The height H12 of the second annular wall portion 412 may be set to be less than the heights of the winding coil 25 and the one end 422*a* of the second extended portion 422 of the second flow passage guide 420, while being positioned outside the second extended portion 422 and inside the first extended portion 421.

For reference, the balance weight 26 may be coupled to the rotary shaft 50. However, in the present embodiment, the balance weight 26 may be fixedly coupled to one surface of the rotator 22 to rotate in cooperation with the rotator.

The annular surface portion 413 connects the first annular wall portion 411 and the second annular wall portion 412. In this case, the first annular wall portion 411, the second annular wall portion 412, and the annular surface portion 413 may be integrally formed. Accordingly, the first flow passage guide 410 may be manufactured as a single product in the same process. Therefore, the manufacturing process may be simplified and the assembly process may be facilitated.

The annular surface portion 413 is fixed in contact with the upper surface 31*a* of the main frame 31. Here, a refrigerant through hole 413*a* is formed in the annular surface portion 413 in a penetrating manner. The refrigerant through hole 413*a* communicates with the second refrigerant hole 311*a* of the main frame 31 that forms the first refrigerant flow passage PG1.

For reference, in another embodiment of the present invention, the first annular wall portion 411 and the second annular wall portion 412 may be integrated with the main frame 31. In this case, the first annular wall portion 411 and the second annular wall portion 412 may protrude from the exposed surface 31*a* of the main frame 31. However, this is merely an example and the present invention is not limited thereto.

Hereinafter, for simplicity, it is assumed that the first annular wall portion 411, the second annular wall portion 412, and the annular surface portion 413 are integrally formed. The second flow passage guide 420 may be extended from an insulator that is inserted into the stator 21 of the drive portion 20 to insulate the coil 25 or may be separately manufactured and coupled with the stator 21.

The second flow passage guide 420 includes a base portion 423 coupled to the stator 21 and serving as an insulator, an outer extended portion 421 (hereinafter referred to as a first extended portion) protruding from the outer side of the base portion 423 toward the main frame, and an inner extended portion 422 (hereinafter referred to as a second extended portion) protruding from the inner side of the base portion 423 toward the main frame.

The base portion 423 is inserted into the slot 211 of the stator 21 to insulate the winding coil 25 from the stator 21. Here, the base portion 423 may be made of an electrically insulative material.

The base portion 423 is fixedly coupled to one surface of the stator 21.

The first extended portion 421 may protrude from the base portion 423 to extend axially downward.

The first extended portion 421 may be formed in an annular shape or may be provided with a plurality of projections. As shown in the drawing, the first extended portion 421 may be formed in an annular shape in order to separate the first space 10*a* in cooperation with the first annular wall portion 411.

The first extended portion 421 has one axial end connected to the base portion 423 and the opposite axial end disposed adjacent to the exposed surface 31*a* of the main frame 31. Here, a part of the first extended portion 421 may extend downward to partially overlap the first annular wall part 411. Thus, the sealing member 430 disposed between the first annular wall portion 411 and the first extended portion 421 may contact the first annular wall portion 411 and the first extended portion 421 at the same time.

Like the first extended portion 421, the second extended portion 422 protrudes to extend from the base portion 423 to the axially opposite end. The second extended portion 422 may be formed in an annular shape like the first extended portion 421.

Here, the protrusion length of the second extended portion 422 may be less than or equal to the protrusion length of the winding coil 25 with respect to the one surface 21*b* of the stator 21. If the protrusion length of the second extended portion 422 is greater than the protrusion length of the winding coil 25, the refrigerant discharged into the first space 10*a* may not be guided into the gap G2 between the stator 21 and the rotator 22, and flow resistance may increase. Therefore, the length of the second extended portion 422 may be set to be less than the protrusion length of the winding coil 25 so as not to disturb the flow passage of the refrigerant discharged through the first flow passage guide 410 if possible. The sealing member 430 is disposed between the first flow passage guide 410 and the second flow passage guide 420.

One surface of the sealing member 430 may be in contact with one surface of the first flow passage guide 410 and the opposite surface thereof may be in contact with one surface of the second flow passage guide 420.

Here, the sealing member 430 is formed in various shapes. For example, the sealing member 430 may be formed in an annular shape so as to be coupled between the first flow passage guide 410 and the second flow passage guide 420. One cross section of the sealing member 430 may have a square bracket shape, an "L" shape, or a straight-line shape. However, this is merely an example according to some embodiments of the present invention, and the shape of the sealing member 430 may be implemented through various modifications.

The sealing member 430 may be attached to or joined to one surface of the first flow passage guide 410 or the second flow passage guide 420. Here, the first flow passage guide 410 or the second flow passage guide 420 may be generally formed of metal or a plastic injection material so as to have sufficient structural rigidity. Therefore, the sealing member 430 may be formed of a material having lower rigidity for sealing than the material of the first flow passage guide 410 or the second flow passage guide 420.

The sealing member 430 may be formed of an elastic material. For example, the sealing member 430 may be composed of a rubber polymer component selected from the group consisting of low-cis isoprene rubber (IR), butadiene rubber (BR), 1,2-polybutadiene rubber, styrene butadiene rubber (SBR), acrylonitrile butadiene rubber (NBR), hydrogenated nitrile rubber (HNBR), urethane rubber (U), ethylene-propylene rubber (EPM), ethylene-propylene-diene rubber (EPDM), chloroprene rubber (CR), and natural rubber (NR).

This is merely an example, and the present invention is not limited thereto. The shape and material of the sealing member 430 may be modified in various ways.

Hereinafter, the sealing member 430 provided in the scroll compressor according to some embodiments of the present invention will be described in detail with reference to FIGS. 7 to 9. Referring to FIG. 7, in the scroll compressor 1, the sealing member 430 is disposed between the first annular wall portion 411 of the first flow passage guide 410 and the second extended portion 422 of the second flow passage guide 420.

One surface of the sealing member 430 may contact one surface of the first annular wall portion 411 and the opposite surface of the sealing member 430 may contact one surface of the first extended portion 421.

The sealing member 430 is formed in an annular shape so as to surround the first annular wall portion 411 and the first extended portion 421. Here, the cross section of the sealing member 430 may be formed in a square bracket shape.

Specifically, the sealing member 430 includes first and second sealing portions 431 and 432 disposed to face each other, and a third sealing portion 433 connecting the first and second sealing portions 431 and 432.

The first sealing portion 431 and the second sealing portion 432 extend in the same direction and the third sealing portion 433 extends in a direction intersecting the first and second sealing portions 431 and 432. The first to third sealing portions 431, 432 and 433 may be integrally formed in the same process and may be made of a single material.

Here, the sealing member 430 has one cross section formed in a square bracket shape, and is coupled to the first annular wall 411 so as to surround an end portion of the first annular wall 411.

That is, the inner surface of the curved portion of the sealing member 430 may be coupled to an end portion of the first annular wall portion 411, and a part of the outer surface of the sealing member 430 may contact the one surface 421*b* of the first extended portion 421. Here, the inner surface of the sealing member 430 may contact three different surfaces of the first annular wall portion 411, and the outer surface of the sealing member 430 may contact one surface of the first extended portion 421.

In other words, one surface of the first sealing portion 431 contacts the side surface 411*b* of the first annular wall portion 411, and the opposite surface of the first sealing portion 431 facing the one surface contacts the side surface 421*b* of the sealing member 430. Here, the second sealing portion 432 and the third sealing portion 433 contact only the first annular wall portion 411 and are arranged spaced apart from the first extended portion 421.

Here, since the sealing member 430 is shaped to be fastened to the end portion of the first annular wall portion 411, it may not be easily separated from the first annular wall portion 411.

In addition, the first annular wall 411 and the first extension 421 may be formed to partially overlap each other with respect to the axial direction. When the height of the first sealing portion 431 is greater than the distance between the upper end surface 411*a* of the first annular wall portion 411 and the lower surface 21*b* of the stator 21, the sealing member 430 may be structurally prevented from being separated from the first flow passage guide 410.

Since the opposite surface of the sealing member 430 is in contact with the side surface 421*b* of the first extended portion 421, the sealing member 430 may be firmly fixed to the first wall portion 411 by the frictional between the sealing member 430 and the first extended portion 421.

For reference, the sealing member 430 is not limited to the square bracket shape described above, but may be formed in various shapes that allow the sealing member 430 to be connected to the end portion of the first annular wall portion 411, contact the side surface 421*b* of the first extended portion 421, be fixed between the first flow passage guide 410 and the second flow passage guide 420. That is, the sealing member 430 may be modified into various shapes satisfying the above-disclosed conditions.

Thereby, the sealing member 430 may completely seal the space between the first flow passage guide 410 and the second flow passage guide 420. As described above, the sealing member 430 is made of an elastic material. The sealing member 430 may closely contact the first flow passage guide 410 and the second flow passage guide 420 through surface contact to prevent the refrigerant or the oil from moving between the refrigerant flow space A1 and the oil flow space A2.

That is, the sealing member 430 may seal the space between the first flow passage guide 410 and the second flow passage guide 420 to completely separate the refrigerant flow space A1 and the oil flow space A2 from each other. As a result, the sealing member 430 of the present invention may prevent movement of the oil from being blocked by the high-pressure refrigerant due to interference between the flow passage through which the refrigerant is discharged and the flow passage through which the oil is recovered.

Further, according to the present invention, the oil may be smoothly recovered into the second space to secure a sufficient amount of oil, thereby preventing the temperature inside the compressor from being increased and improving reliability of the compressor.

Further, the sealing member 430 of the present invention may more precisely separate the refrigerant flow passage and the oil flow passage from each other and minimize decrease in the oil recovery caused by the refrigerant. Therefore, the present invention may improve the efficiency of the compressor by reducing the amount of leaking oil discharged from the compressor along with the refrigerant.

Hereinafter, the sealing member 430 provided in a scroll compressor 2 according to another embodiment of the present invention will be described. In the following description, the contents overlapping with the description above will be omitted and differences will be mainly described. Referring to FIG. 8, in the scroll compressor 2 according to another embodiment of the present invention, one surface of the scroll compressor 430 may contact the side surface 411*b* of the first flow passage guide 410, and the opposite side surface of the first flow passage guide 410 may contact one surface 421*a* of the second flow passage guide 420.

The sealing member 430 may be formed in an annular shape along the circumference of the first annular wall portion 411 and the first extended portion 421. Here, the cross section of the sealing member 430 may have an "L" shape.

Specifically, the sealing member 430 includes a first sealing portion 434 and a second sealing portion 435 that extend in directions intersecting with each other. Here, in the cross section, the sealing member 430 may be formed to extend in directions intersecting with each other. For example, the first sealing portion 434 and the second sealing portion 435 of the sealing member 430 may be arranged to be perpendicular to each other. Here, the first and second sealing portions 434 and 435 may be integrally formed in the same process and be formed of the same material. In addition, the first and second sealing portions 434 and 435 may be formed to have the same thickness.

Here, the first sealing portion 434 may contact at least one surface of the first flow passage guide 410. For example, the first sealing portion 434 may be disposed to contact the side surface 411*b* of the first annular wall portion 411 or one surface of the annular surface portion 413. The second sealing portion 435 may be disposed to contact the opposite end surface of the second flow passage guide 420.

The height H23 of the first sealing portion 434 measured from the exposed surface of the annular surface portion 413 is set to be less than the height H22 of the first annular wall portion 411.

The sum of the height H23 of the first sealing portion 434 and the height of the first extended portion 421 may be equal to the distance between the exposed surface of the face portion 413 and the exposed surface of the base portion 423. That is, the height H23 of the sealing member 430 may be equal to the length from the exposed surface of the annular surface portion 413 to the one end surface of the first extended portion 421.

Since the sealing member 430 is in contact with the side surface of the first annular wall portion 411, the exposed surface of the annular surface portion 413, and the one end surface of the first extended portion 421, the sealing member 430 may be fixed between the first flow passage guide 410 and the second flow passage guide 420. Here, the sealing member 430 is in surface contact with the first flow passage guide 410 and the second flow passage guide 420.

Thus, the sealing member 430 may completely seal the space between the first flow passage guide 410 and the second flow passage guide 420. As described above, the sealing member 430 is made of an elastic material. The sealing member 430 is in close contact with the first flow passage guide 410 and the second flow passage guide 420 through surface contact. Accordingly, the flow passage between the refrigerant flow space A1 and the oil flow space A2 may be blocked.

For reference, the sealing member 430 is not limited to the L-shape, but may be formed in various shapes that allow the sealing member 430 to contact the side surface 411*b* of the first annular wall portion 411 and the one end surface 421*a* of the first extended portion 421 while being fixed between the first flow passage guide 410 and the second flow passage guide 420. That is, the sealing member 430 may be modified into various shapes satisfying the above-disclosed conditions.

Hereinafter, the sealing member 430 included in a scroll compressor 3 according to another embodiment of the present invention will be described. In the following description, the contents overlapping with the description above will be omitted and the differences will be mainly described. Referring to FIG. 9, in the scroll compressor 3 according to another embodiment of the present invention, one surface of the scroll compressor 430 may contact the side surface 411*b* of the first flow passage guide 410, and the opposite side surface of the first flow passage guide 410 may contact one surface 421*a* of the second flow passage guide 420.

Similarly, the sealing member 430 may be formed in an annular shape along the circumference of the first annular wall portion 411 and the first extended portion 421. Here, the cross section of the sealing member 430 may be formed in a linear shape (for example, a straight-line shape) extending only in one direction. That is, the sealing member 430 may be formed to extend only in the same direction.

Here, the sealing member 430 may be formed of a single material and may have the same thickness.

Specifically, one surface 430*b* of the sealing member 430 contacts the side surface 411*b* of the first annular wall portion 411, and the opposite surface 430*a* of the sealing member 430 facing the one surface 430*b* contacts the side surface 421*b* of the first extended portion 421.

Here, one of the upper end surface and the lower end surface of the sealing member 430 may be in contact with the upper surface of the annular surface portion 413 or the base portion 423 and the other end surface may be spaced apart the annular surface portion 413 or the base portion 423.

That is, the height H32 of the sealing member 430 may be set to be less than the height H31 between the exposed surface of the first annular wall portion 411 and the exposed surface of the first extended portion 421. This is intended to prevent unintentional force from being applied to the first flow passage guide 410 and the second flow passage guide 420 when the sealing member 430 is expanded by heat.

For reference, the height H32 of the sealing member 430 may be set to be equal to the height H31 between the exposed surface of the first annular wall portion 411 and the exposed surface of the first extended portion 421, or the sealing member 430 may be disposed spaced apart from the first annular wall portion 411 and the first extended portion 421.

In addition, the first annular wall portion 411 and the first extended portion 421 may be formed to partially overlap each other with respect to the axial direction. The height H32 of the sealing member 430 is set to be greater than the axial length of the first annular wall portion 411 and the first extended portion 421. Accordingly, the sealing member 430 may be fixed between the first annular wall portion 411 and the first extended portion 421.

In addition, the sealing member 430 may be made of an elastic material, and may be composed of a shrinkable tube or an HNBR band. Here, the sealing member 430 contacts the side surface 411*b* of the first annular wall portion 411 and the side surface 421*b* of the first extended portion 421. That is, the sealing member 430 may make a surface contact with the first flow passage guide 410 and the second flow passage guide 420, and may be fixed in close contact with the first flow passage guide 410 and the second flow passage guide 420 arranged on both sides thereof.

Thus, the sealing member 430 may completely seal the space between the first flow passage guide 410 and the second flow passage guide 420. As described above, the sealing member 430 is made of an elastic material. Since the sealing member 430 is in close contact with the first flow passage guide 410 and the second flow passage guide 420 through the surface contact, the flow passage between the refrigerant flow space A1 and the oil flow space A2 may be blocked.

For reference, the sealing member 430 is not limited to the linear shape, but may be formed in various shapes that allow the sealing member 430 to contact the side surface 411*b* of the first annular wall portion 411 and the side surface 421*b* of the first extended portion 421 while being fixed between the first flow passage guide 410 and the second flow passage guide 420. That is, the sealing member 430 may be modified into various shapes satisfying the above-disclosed conditions.

Figure 10:
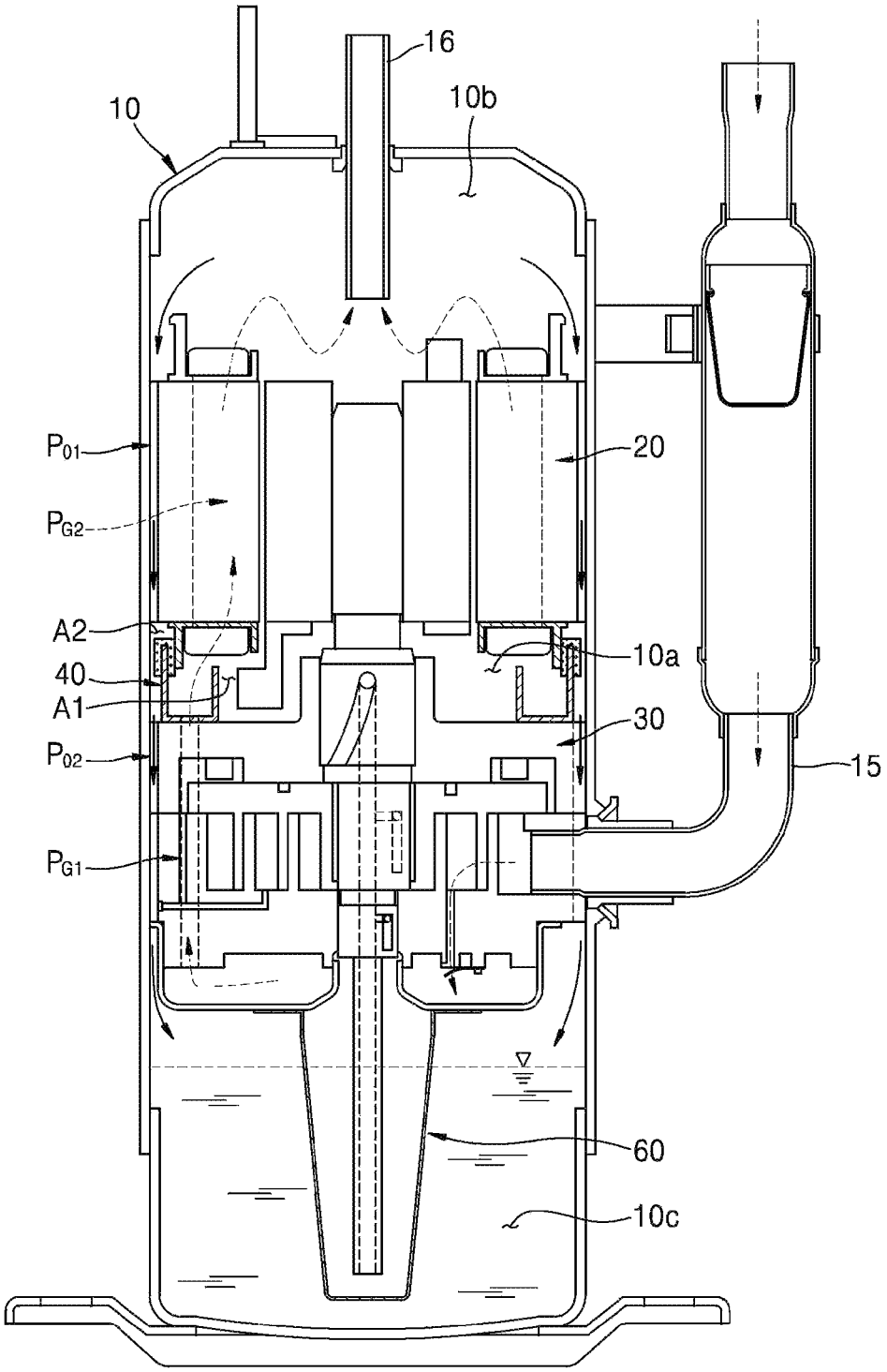
FIG. 10 is a schematic view illustrating a process in which a refrigerant and oil are separated and flow in the scroll compressor of FIG. 10.

FIG. 10 is a schematic view illustrating a process in which a refrigerant and oil are separated and flow in the scroll compressor of FIG. 10.

Referring to FIG. 10, the refrigerant and oil flow in the scroll compressor according to the embodiment of the present invention is as follows.

The inner space of the casing 10 is divided into three spaces. That is, the casing 10 includes a first space 10*a* positioned between the drive portion 20 and the compression portion 30, a second space 10*b* positioned between the drive portion 20 and the refrigerant discharge pipe, and a third space 10*c* spaced apart from the compression portion 30 so as to form an oil reservoir space.

Here, the first space 10*a* is divided into the refrigerant flow space A1 arranged on the inner side and the oil flow space A2 arranged on the outer side by the flow passage separation unit 40.

Here, the refrigerant flow space A1 communicates with the first refrigerant flow passage PG1 and the second refrigerant flow passage PG2, and the oil flow space A2 communicates with the first oil flow passage PO1 and the second oil flow passage PO2.

The refrigerant (indicated by dotted arrow lines) discharged from the compression portion 30 to the inner space of the discharge cover 34 moves to the refrigerant flow space A1 of the first space 10*a* through the first refrigerant flow passage PG1. Subsequently, the refrigerant is moves to the second space 10*b* through the second refrigerant flow passage PG2 by the flow passage separation unit 40.

Here, the second annular wall portion 412 of the first flow passage guide 410 constituting the flow passage separation unit 40 is configured to divide the refrigerant flow space A1 into a first refrigerant flow space A11 and a second refrigerant flow space A12 to prevent the refrigerant from flowing into the range of the rotation locus of the balance weight 26.

Accordingly, the flow passage separation unit 40 may prevent the refrigerant from being stirred by the balance weight 26.

The refrigerant moving to the second space 10*b* contains oil, but the oil is separated from the refrigerant while the refrigerant circulates in the second space 10*b*. Then, the separated refrigerant is discharged from the compressor through the refrigerant discharge pipe 16, while the separated oil (indicated by solid arrow lines) flows away from the drive portion 20 through the first oil flow passage PO1 formed on the outer circumferential surface of the stator 21.

Then, the oil that moves away from the drive portion 20 through the first oil flow passage PO1 is not introduced into the inner space from the outer space in the first space 10*a* by the oil flow passage separation unit 40, but is moved to the third space 10*c* via the second oil flow passage PO2 and stored therein.

Accordingly, the oil separated in the second space 10*b* may be quickly moved into the third space 10*c*, which is the oil reservoir space, and thus oil shortage may be prevented from occurring in the compressor.

In particular, the flow passage separation unit 40 according to some embodiments of the present invention is provided with the sealing members 430, which may be formed in various shapes, to separate the inner space and the outer space in the first space 10*a* from each other. Accordingly, the sealing member 430 may prevent the refrigerant discharged into the first space 10*a* from flowing into the oil flow passages PO1 and PO2, thereby further enhancing the oil recovery effect.

Further, according to the present invention, the oil may be smoothly recovered into the third space 10*c* to secure a sufficient amount of oil, thereby preventing the temperature inside the compressor from being increased and improving reliability of the compressor.

Further, the sealing member 430 of the present invention may more thoroughly separate the refrigerant flow passage and the oil flow passage from each other and minimize decrease in the oil recovery caused by the refrigerant. Therefore, the present invention may improve the efficiency of the compressor by reducing the amount of leaking oil discharged from the compressor along with the refrigerant.

As apparent from the above description, the present invention has effects as follows.

In a scroll compressor according to the present invention, a refrigerant discharged from a compression portion moves to a refrigerant discharge pipe through a refrigerant flow passage. On the other hand, the oil separated from the refrigerant on one side of the drive portion moves to the second space through the oil flow passage. At this time, the flow passage separation unit of the present invention completely separates the refrigerant discharge path from the oil recovery path. Accordingly, the present invention may prevent movement of the oil from being blocked by the high-pressure refrigerant due to interference between the flow passage through which the refrigerant is discharged and the flow passage through which the oil is recovered. That is, according to the present invention, the oil may be smoothly recovered into the second space, and oil shortage in the compressor may be prevented.

Further, in the scroll compressor according to the present invention, a sealing member is added to the flow passage separation unit for separating the refrigerant flow passage from the oil flow passage to ensure that a refrigerant leakage path is not created in the flow passage separation unit. Accordingly, the present invention may minimize degradation of oil recovery, which is caused by the refrigerant, by separating the refrigerant flow passage from the oil flow passage. Therefore, the present invention may secure a sufficient amount of oil through smooth oil recovery, thereby preventing the temperature from rising inside the compressor and improving reliability of the compressor.

Further, the scroll compressor according to the present invention includes a sealing member fixed between the first and second oil guides through surface contact to prevent the refrigerant leakage path from being created in the flow passage separation unit. Accordingly, the present invention may more precisely separate the refrigerant flow passage from the oil flow passage and minimize decrease in the oil recovery caused by the refrigerant. Further, the present invention may improve the efficiency of the compressor by reducing the amount of leaking oil discharged together with the refrigerant from the compressor.

It will be apparent to those skilled in the art that various substitutions, modifications, and variations can be made in the present invention without departing from the spirit and scope of the invention. Thus, it is intended that the present invention cover the modifications and variations of this invention provided they come within the scope of the appended claims and their equivalents. Therefore, the present invention is not limited by the above-described embodiments and the accompanying drawings.

What is claimed is:

1. A scroll compressor comprising:

a casing;

a drive portion coupled to an interior of the casing;

a rotary shaft that extends from the drive portion and that is configured to be rotated by the drive portion;

a compression portion coupled to the rotary shaft and configured to compress and discharge refrigerant; and a flow passage separation unit that divides a space defined between the drive portion and the compression portion into an inside space and an outside space, the outside space being radially outward from the inside space with respect to the rotary shaft, the flow passage separation unit comprising:

a first flow passage guide that extends from the compression portion toward the drive portion, the first flow passage guide comprising a first annular wall portion that extends from the compression portion toward the drive portion, a second flow passage guide that extends from the drive portion toward the compression portion, the second flow passage guide comprising a first extended portion that extends from the drive portion toward the compression portion and that is radially inward from the first annular wall portion with respect to the rotary shaft, and a sealing member that contacts at least one of the first annular wall portion or the first extended portion and covers a gap defined between the first annular wall portion and the first extended portion.

2. The scroll compressor of claim 1, wherein the sealing member has a first surface that contacts a side surface of the first annular wall portion and a second surface that contacts a side surface of the first extended portion.

3. The scroll compressor of claim 1, wherein the sealing member accommodates a first end of the first flow passage guide and contacts a second end of the second flow passage guide.

4. The scroll compressor of claim 3, wherein the sealing member comprises:

a first sealing portion that contacts a first surface of the first annular wall portion, a second sealing portion that contacts both of a second surface of the first annular wall portion opposite to the first surface and a surface of the first extension portion, and a third sealing portion that connects the first sealing portion to the second sealing portions.

5. The scroll compressor of claim 1, wherein the sealing member has a C-shape, and receives at least a portion of the first flow passage guide.

6. The scroll compressor of claim 1, wherein the sealing member comprises:

a first sealing portion that contacts a side surface of the first annular wall portion, and a second sealing portion that extends from the first sealing portion and that contacts an end of the first extended portion.

7. The scroll compressor of claim 6, wherein the first flow passage guide further comprises:

a second annular wall portion that is radially spaced apart from the first annular wall portion and that extends from the compression portion toward the drive portion; and an annular surface portion that connects the first annular wall portion to the second annular wall portion and that contacts a surface of the compression portion, and wherein the first sealing portion contacts both of the annular surface portion and the first annular wall portion.

8. The scroll compressor of claim 7, wherein a height of the first sealing portion is equal to a distance from the annular surface portion to the end of the first extended portion.

9. The scroll compressor of claim 1, wherein the first extended portion is spaced apart from the first annular wall portion in a radial direction of the rotary shaft, and an end of the first extended portion is longitudinally spaced apart from an end of the first annular wall portion, and wherein the sealing member has an L-shape and is configured to cover a gap defined between the first annular wall portion and the first extended portion.

10. The scroll compressor of claim 1, wherein the first flow passage guide is spaced apart from the second flow passage guide in a radial direction of the rotary shaft, and wherein the sealing member comprises end portions that are supported by the first flow passage guide and the second flow passage guide.

11. The scroll compressor of claim 10, wherein the first extended portion is spaced apart from an end of the first annular wall portion in the radial direction of the rotary shaft, and wherein the sealing member contacts both of an inner surface of the first annular wall portion and an outer surface of the first extended portion.

12. The scroll compressor of claim 11, wherein the sealing member extends in a longitudinal direction between the drive portion and the compression portion, and wherein a length of the sealing member in the longitudinal direction is greater than a length of each of the first annular wall portion and the first extended portion in the longitudinal direction.

13. The scroll compressor of claim 1, wherein the sealing member is disposed between the first flow passage guide and the second flow passage guide, the sealing member being in surface contact with the first flow passage guide and the second flow passage guide.

14. The scroll compressor of claim 13, wherein the first flow passage guide and the second flow passage guide partially overlap each other in a radial direction of the drive portion.

15. The scroll compressor of claim 14, wherein the sealing member has a C-shape, and wherein the sealing member has:

an inner surface that is coupled to the first flow passage guide and that contacts the first flow passage guide; and an outer surface, a part of the outer surface contacting a side surface of the second flow passage guide.

16. The scroll compressor of claim 14, wherein the sealing member has an L-shape, and wherein the sealing member has:

an end portion disposed at a first side of the sealing member and supported by the first flow passage guide; and a contact surface that is disposed at a second side of the sealing member opposite the first side and that contacts the drive portion or the second flow passage guide.

17. The scroll compressor of claim 14, wherein the sealing member has a straight-line shape, and wherein the sealing member has:

a first surface that contacts the first flow passage guide; and a second surface that contacts the second flow passage guide.

18. The scroll compressor of claim 1, further comprising:

a stator coupled to an inner space of the casing, the stator comprising a coil winding portion around which one or more coils are wound, the coil winding portion being disposed at an inner circumferential surface of the stator;

a rotator accommodated in the stator and configured to rotate relative to the stator;

a main frame that is spaced apart from the stator and that supports the rotary shaft, the rotary shaft extending through the main frame;

a fixed scroll disposed at a surface of the main frame; and a rotating scroll that is disposed between the main frame and the fixed scroll and that is pivotally engaged with the fixed scroll to thereby define a compression chamber, wherein the first flow passage guide extends from the main frame toward the stator, and the second flow passage guide extends from the stator toward the main frame, and wherein the sealing member has a first surface that contacts the first flow passage guide, and a second surface that contacts the second flow passage guide.

19. The scroll compressor of claim 18, wherein the sealing member has a C-shape, and wherein the first surface receives an end of the first flow passage guide, and wherein the second surface contacts the second flow passage guide.

20. The scroll compressor of claim 18, wherein the sealing member has an L-shape, wherein the first flow passage guide supports an end of the sealing member, and wherein the second surface of the sealing member contacts a surface of the second flow passage guide.

* * * * *